US010475373B2

(12) United States Patent
Matsumoto

(10) Patent No.: US 10,475,373 B2
(45) Date of Patent: Nov. 12, 2019

(54) DISPLAY DEVICE

(71) Applicant: NICHIA CORPORATION, Anan-shi (JP)

(72) Inventor: Makoto Matsumoto, Tokushima (JP)

(73) Assignee: NICHIA CORPORATION, Anan-shi (JP)

( * ) Notice: Subject to any disclaimer, the term of this patent is extended or adjusted under 35 U.S.C. 154(b) by 68 days.

(21) Appl. No.: 15/822,208

(22) Filed: Nov. 27, 2017

(65) Prior Publication Data

US 2018/0151110 A1 May 31, 2018

(30) Foreign Application Priority Data

Nov. 29, 2016 (JP) ..... 2016-230744

(51) Int. Cl.

*G09G 3/32* (2016.01)
*G09G 3/20* (2006.01)
*G09G 3/34* (2006.01)

(52) U.S. Cl.

CPC ..... *G09G 3/32* (2013.01); *G09G 3/2014* (2013.01); *G09G 3/2022* (2013.01); *G09G 3/2025* (2013.01); *G09G 3/3413* (2013.01); *G09G 2300/0452* (2013.01); *G09G 2320/0242* (2013.01); *G09G 2320/0252* (2013.01); *G09G 2320/062* (2013.01); *G09G 2320/0666* (2013.01)

(58) Field of Classification Search

CPC ... G09G 2300/0452; G09G 2320/0242; G09G 2320/0252; G09G 2320/062; G09G 2320/0666; G09G 3/2014; G09G 3/2022; G09G 3/2025; G09G 3/32; G09G 3/3413

See application file for complete search history.

(56) References Cited

U.S. PATENT DOCUMENTS

2003/0016198 A1 1/2003 Nagai et al.
2005/0162360 A1* 7/2005 Ishihara ..... G09G 3/2011 345/89
2006/0232601 A1 10/2006 Kimura et al.
2008/0129672 A1* 6/2008 Ishihara ..... G09G 3/2022 345/89

(Continued)

FOREIGN PATENT DOCUMENTS

JP 5-127636 5/1993
JP 10-39835 2/1998

(Continued)

*Primary Examiner* — Dmitriy Bolotin
(74) *Attorney, Agent, or Firm* — Mori & Ward, LLP

(57) ABSTRACT

A display device including a display unit including a plurality of light emitting elements, and a control unit that individually controls the plurality of light emitting elements in each of a plurality of main frames according to the gradation data externally input based on output from an external device. The plurality of main frames each include a plurality of sub-frames. The control unit turns on predetermined ones of the plurality of light emitting elements in a predetermined one of the plurality of main frames such that a difference between a gradation value of one or more of the plurality of sub-frames having a maximum gradation value and a gradation value of one or more of the plurality of sub-frames having a minimum gradation value is at least 2.

17 Claims, 7 Drawing Sheets

(56) References Cited

U.S. PATENT DOCUMENTS

| | | | | |
|---|---|---|---|---|
| 2009/0262148 | A1* | 10/2009 | Kimura | G09G 3/2003 345/690 |
| 2010/0053223 | A1 | 3/2010 | Otsuka et al. | |
| 2014/0232706 | A1* | 8/2014 | Iwasa | G02F 1/136213 345/206 |
| 2014/0320477 | A1* | 10/2014 | Izawa | G09G 3/2022 345/212 |
| 2016/0321980 | A1* | 11/2016 | Matsumoto | G09G 3/2025 |
| 2018/0151110 | A1* | 5/2018 | Matsumoto | G09G 3/2014 |
| 2018/0174502 | A1* | 6/2018 | Matsumoto | G09G 3/2018 |

FOREIGN PATENT DOCUMENTS

| | | |
|---|---|---|
| JP | 10-149128 | 6/1998 |
| JP | 2000-148088 | 5/2000 |
| JP | 2001-290458 | 10/2001 |
| JP | 2003-099003 | 4/2003 |
| JP | 2004-177612 | 6/2004 |
| JP | 2006-119212 | 5/2006 |
| JP | 2006-195306 | 7/2006 |
| JP | 2006-317909 | 11/2006 |
| JP | 2010-054989 | 3/2010 |
| JP | 2013-019921 | 1/2013 |

* cited by examiner

FIG.4

| Gradation Value of Main Frame | Gradation Value of Sub Frame | | | |
|---|---|---|---|---|
| | Sub Frame 1 | Sub Frame 2 | Sub Frame 3 | Sub Frame 4 |
| 12 | 3 | 3 | 3 | 3 |
| 11 | 2 | 3 | 3 | 3 |
| 10 | 2 | 3 | 2 | 3 |
| 9 | 2 | 2 | 3 | 2 |
| 8 | 2 | 2 | 2 | 2 |
| 7 | 1 | 2 | 2 | 2 |
| 6 | 0 | 2 | 2 | 2 |
| 5 | 0 | 2 | 1 | 2 |
| 4 | 0 | 2 | 0 | 2 |
| 3 | 0 | 2 | 0 | 1 |
| 2 | 0 | 2 | 0 | 0 |
| 1 | 0 | 0 | 1 | 0 |
| 0 | 0 | 0 | 0 | 0 |

FIG.5

| Gradation Value of Main Frame | Gradation Value of Sub Frame | | | |
|---|---|---|---|---|
| | Sub Frame 1 | Sub Frame 2 | Sub Frame 3 | Sub Frame 4 |
| 12 | 3 | 3 | 3 | 3 |
| 11 | 2 | 3 | 3 | 3 |
| 10 | 2 | 3 | 2 | 3 |
| 9 | 2 | 2 | 3 | 2 |
| 8 | 2 | 2 | 2 | 2 |
| 7 | 1 | 2 | 2 | 2 |
| 6 | 1 | 2 | 1 | 2 |
| 5 | 1 | 1 | 2 | 1 |
| 4 | 1 | 1 | 1 | 1 |
| 3 | 0 | 1 | 1 | 1 |
| 2 | 0 | 1 | 0 | 1 |
| 1 | 0 | 0 | 1 | 0 |
| 0 | 0 | 0 | 0 | 0 |

DISPLAY DEVICE

CROSS-REFERENCE TO RELATED APPLICATION

This application claims priority to Japanese Patent Application No. 2016-230744, filed on Nov. 29, 2016, the disclosure of which is hereby incorporated by reference in its entirety.

BACKGROUND OF THE INVENTION

The present invention relates to a display device.

A display device including a display unit which includes a plurality of light emitting elements, and a control unit that turns on the plurality of light emitting elements at different gradation values has been proposed in Japanese Patent Publication No. 2010-054989.

SUMMARY OF THE INVENTION

In the aforementioned conventional display device, however, when the gradation value approaches zero, lowering the luminance, the lighting period of an individual light emitting element is shortened which likely allows for a distinguishable difference between a desired chromaticity and the chromaticity actually obtained.

Therefore, a need exists to solve the above-mentioned problem.

The present invention advantageously provides a display device including a display unit including a plurality of light emitting elements, and a control unit that individually controls the plurality of light emitting elements in each of a plurality of main frames according to gradation data externally input based on output from an external device. The plurality of main frames each include a plurality of sub-frames. The control unit turns on predetermined ones of the plurality of light emitting elements in a predetermined one of the plurality of main frames such that a difference between a gradation value of one or more of the plurality of sub-frames having a maximum gradation value and a gradation value of one or more of the plurality of sub-frames having a minimum gradation value is at least 2.

According to an embodiment of the present invention, a display device can be provided in which a chromaticity shift between a desired chromaticity and a chromaticity actually obtained is less distinguishable even at a relatively low luminance.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIG. 4 is a chart illustrating in detail a control applied to green light emitting elements L21-L24 of FIG. 1;

FIG. 5 is a chart illustrating in detail a control applied to red light emitting elements L11-L14 of FIG. 1;

DETAILED DESCRIPTION OF EXEMPLARY EMBODIMENTS OF THE INVENTION

Figure 1:
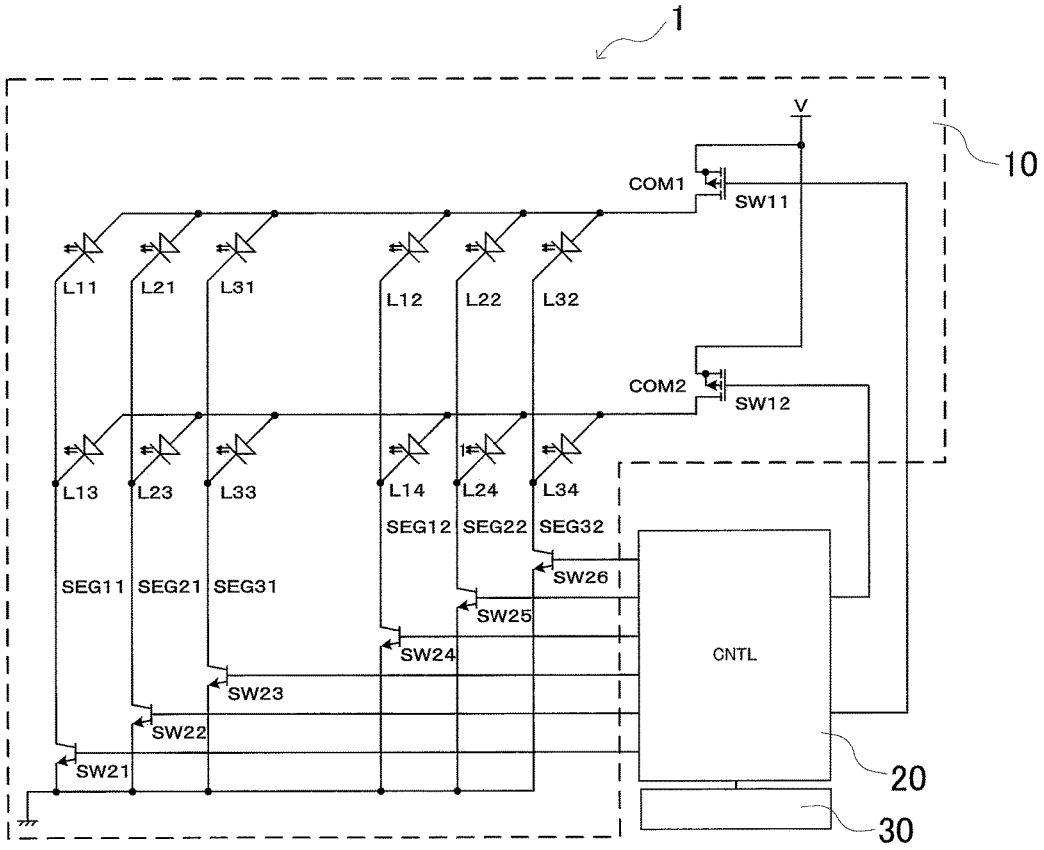
FIG. 1 is a circuit diagram of a display device according to an embodiment of the present invention.

FIG. 1 is a circuit diagram of a display device 1 according to an embodiment of the present invention. As shown in FIG. 1, the display device 1 includes a display unit 10 and a control unit 20. The display unit 10 includes a plurality of light emitting elements L11-L34 (i.e., L11, L12, L13, L14, L21, L22, L23, L24, L31, L32, L33, and L34), common lines COM 1 and COM2, a power supply V, and drive lines SEG11-SEG32 (i.e., SEG 11, SEG 12, SEG 21, SEG 22, SEG 31, and SEG 32). The plurality of light emitting elements L11-L34 configured with red light emitting elements L11-L14, green light emitting elements L21-L24, and blue light emitting elements L31-L34. Each component will be explained in detail below.

Light Emitting Elements L11-L34

The display unit 10 has a plurality of pixels. Each pixel, for example, is structured with one or more of the red light emitting elements L11-L14, one or more of the green light emitting elements L21-L24, and one or more of the blue light emitting elements L31-L34. The red light emitting elements L11-L14 typically refer to those light emitting elements each having a peak emission wavelength range from 615 nm to 645 nm at a 20 mA of forward current. The green light emitting elements L21-L24 typically refer to those light emitting elements each having a peak emission wavelength range from 500 nm to 560 nm at a 20 mA of forward current. The blue light emitting elements L31-L34 typically refer to those light emitting elements each having a peak emission wavelength range from 450 nm to 490 nm at a 20 mA of forward current. For each light emitting element, a light emitting diode (LED), for example, can be used.

Figure 2A:
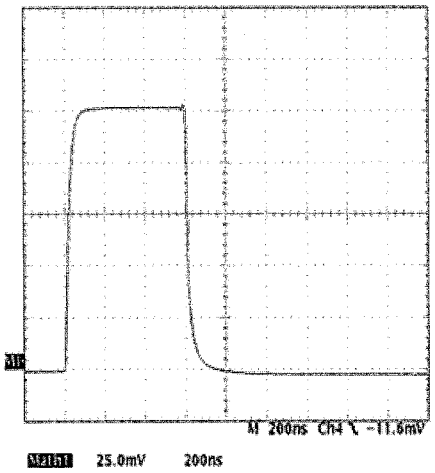
FIG. 2A is a chart showing an example of a relationship between time and an output of a red light emitting element.
Figure 2B:
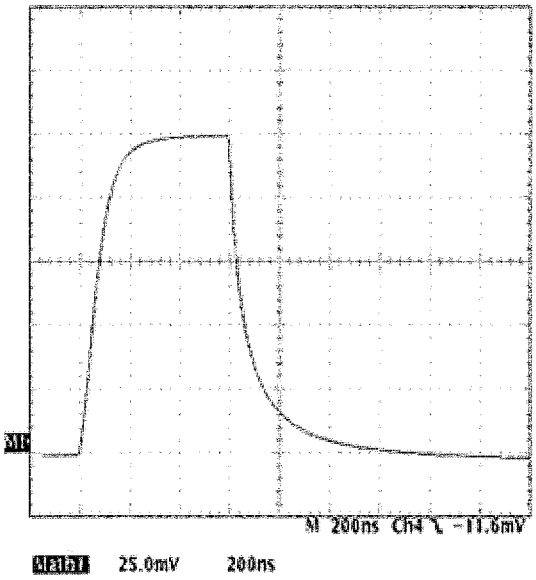
FIG. 2B is a chart showing an example of a relationship between time and an output of a green light emitting element.
Figure 2C:
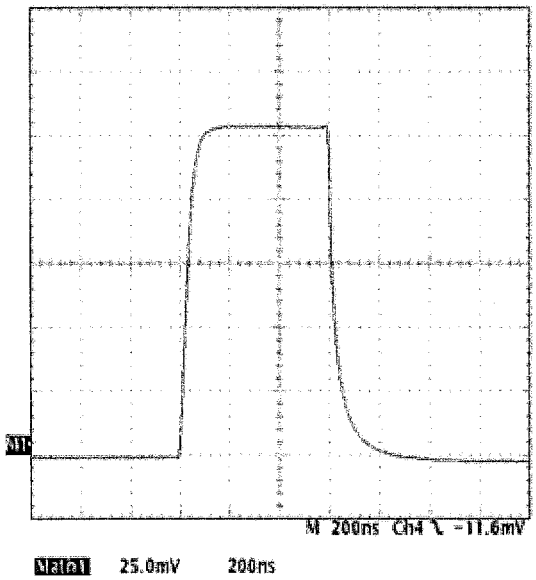
FIG. 2C is a chart showing an example of a relationship between time and an output of a blue light emitting element.

FIG. 2A is a chart showing an example of a relationship between time and an output of one of the red light emitting elements. FIG. 2B is an example of a relationship between time and an output of one of the green light emitting elements. FIG. 2C is an example of a relationship between time and an output of one of the blue light emitting elements. In FIGS. 2A to 2C, the horizontal axis represents time, and the vertical axis represents output. In FIGS. 2A to 2C each division on the horizontal axis represents 200 ns. As shown in FIGS. 2A to 2C, when a light emitting element is pulse-driven, the output of the light emitting element is unstable when the output rises and falls. In the following explanations, the state in which the output of a light emitting element is stable will be referred to as a steady state, and the state in which the output of a light emitting element is unstable will be referred to as a transient state. A period during which a light emitting element is in a steady state will be referred to as a steady state period, and a period during which a light emitting element is in a transient state will be referred to as a transient state period. In the case of a very short steady state period, it is difficult to allow a light emitting element to turn on with a luminance close to the desired luminance or with a chromaticity close to the desired chromaticity. A lighting period (i.e., the period from the rise to the fall of the output of a light emitting element) constitutes a steady state period and transient state periods.

The output rise time of the red light emitting elements L11-L14 is about 40 ns to about 45 ns, and the output fall time thereof is about 50 ns to 55 ns. The output rise time of the blue light emitting elements L31-L34 is about 60 ns to about 70 ns, and the output fall time thereof is about 80 ns to about 100 ns. In contrast, the output rise time of the green light emitting elements L21-L24 is about 130 ns to 150 ns, and the output fall time thereof is about 220 ns to about 240 ns. As such, the green light emitting elements L21-L24 have longer output rise time and longer output fall time as compared to the red light emitting elements L11-L14 and the blue light emitting elements L31-L34. For this reason, in the case of the green light emitting elements L21-L24 whose lighting period is very short, the lighting period is dominantly accounted for by transient periods to thereby shorten the steady state period which makes it difficult to turn on the light emitting elements with a chromaticity close to the desired chromaticity.

As compared to the red light emitting elements L11-L14 and the blue light emitting elements L31-L34, the green light emitting elements L21-L24 tend to have more extensive chromaticity variance attributable to the variance of the current supplied. The details of the reason for this are unclear, but are believed to be attributable to the fact that LEDs are primarily used as the light emitting elements. In general, both blue and green LEDs are made of nitride semiconductors, but a green LED contains more indium in the active layer where light is emitted, which is believed to be the cause of the extensive chromaticity variance resulting from varying current values. Accordingly, compared to the red light emitting elements L11-L14 and the blue light emitting elements L31-L34, the green light emitting elements L21-L24 tend to have a chromaticity shift between a steady state period and a transient state period, and when the steady state period is very short, the chromaticity shift from what is desired tends to be extensive.

The red light emitting elements L11-L14 and the blue light emitting elements L31-L34 have relatively short output rise time and short output fall time compared to those of the green light emitting elements L21-L24. For this reason, even in the case of a very short lighting period, a relatively long steady state period can be ensured. Moreover, the red light emitting elements L11-L14 and the blue light emitting elements L31-L34 have relatively small chromaticity variance attributable to current value variance, and the chromaticity does not shift much between a steady state period and a transient state period. Accordingly, it is relatively easy to turn on the red light emitting elements L11-L14 and the blue light emitting elements L31-L34 with a chromaticity close to the desired chromaticity.

Common Lines COM1, and COM2

The common lines COM1 and COM2 are respectively connected to ends of the light emitting elements L11-L34. The light emitting elements L11-L34 may be connected to the common lines COM1 and COM2 at their common anode or common cathode. The common lines COM1 and COM2 may be branched or diverged along the way. In the present embodiment, two common lines are provided, but the number of common lines may be any as long as it is one or more.

Drive Lines SEG11-SEG32

A plurality of drive lines SEG11-SEG32 are connected to the respective other ends of the light emitting elements L11-L34.

Copper foil or the like can be used for the common lines COM1 and COM2, and the drive lines SEG11-SEG32. Copper foil refers to the wiring provided on a printed wiring board. The common lines COM1 and COM2, and the drive lines SEG11-SEG32 can be formed into various shapes on a printed wiring board, such as linear, planar (e.g., a square or circular shape), or the like. The use of the term, "line," is not intended to limit the actual shapes of the common lines COM1 and COM2, or the drive lines SEG11-SEG32. The term is merely used to schematically describe the common lines COM1 and COM2, and the drive lines SEG11-SEG32 in a circuit diagram.

Power Supply V

The power supply V supplies voltage to the light emitting elements L11-L34. In the case where two or more common lines are provided, the power supply V may be provided per common line. However, the power supply V can be shared by two or more common lines. In the case where the power supply V is shared by two or more common lines, the voltage supplied by the power supply V may always be applied to each common line by way of static control, or may be applied by way of time-divided dynamic control. For example, a series or switched mode constant voltage direct current power supply can be used for the power supplies V.

Source Drivers SW11 and SW12

The source drivers SW11 and SW12 are switches for connecting the common lines COM1 and COM2 to the power supply V, and are turned ON or OFF by the control unit 20 using a time-division switching technique. For the source drivers SW11 and SW12, a P-channel FET or PNP transistor can be used. FET stands for "field effect transistor".

Sink Drivers SW21-SW26

The sink drivers SW21-SW26 are respectively connected to the drive lines SEG11-SEG32. The sink drivers SW21-SW26 are switches for connecting the drive lines SEG11-SEG32 to GND, and are turned ON or OFF by the control unit 20. For the sink drivers SW21-SW26, an NPN transistor or N-channel FET can be used. The electric current flowing to the drive lines SEG11-SEG32 can be controlled by an element or device, such as a resistor, constant current source, or the like. These elements or devices can be disposed between the individual sink drivers SW21-SW26 and GND, or between the individual sink drivers SW21-SW26 and the light emitting elements L11-L34.

Control Unit 20

For the control unit 20, an FPGA, microcomputer, or combination of these can be used. FPGA stands for "field programmable gate array".

The control unit 20 controls individual light emitting elements L11-L34. They are controlled by using, for example, pulse width modulation (PWM). In other words, the control unit 20 controls the light emitting elements L11-L34 by turning ON or OFF the sink drivers SW21-SW26 to apply voltage having a predetermined pulse width to the light emitting elements L11-L34. To give an example, the control unit 20 supplies an electric current by turning ON or OFF the sink drivers SW12 and SW25 to apply voltage having a predetermined pulse width along the route: power supply V→common line COM2→light emitting element L24→drive line SEG22→GND. This turns on the light emitting element L24 for a predetermined period of time.

Figure 3:
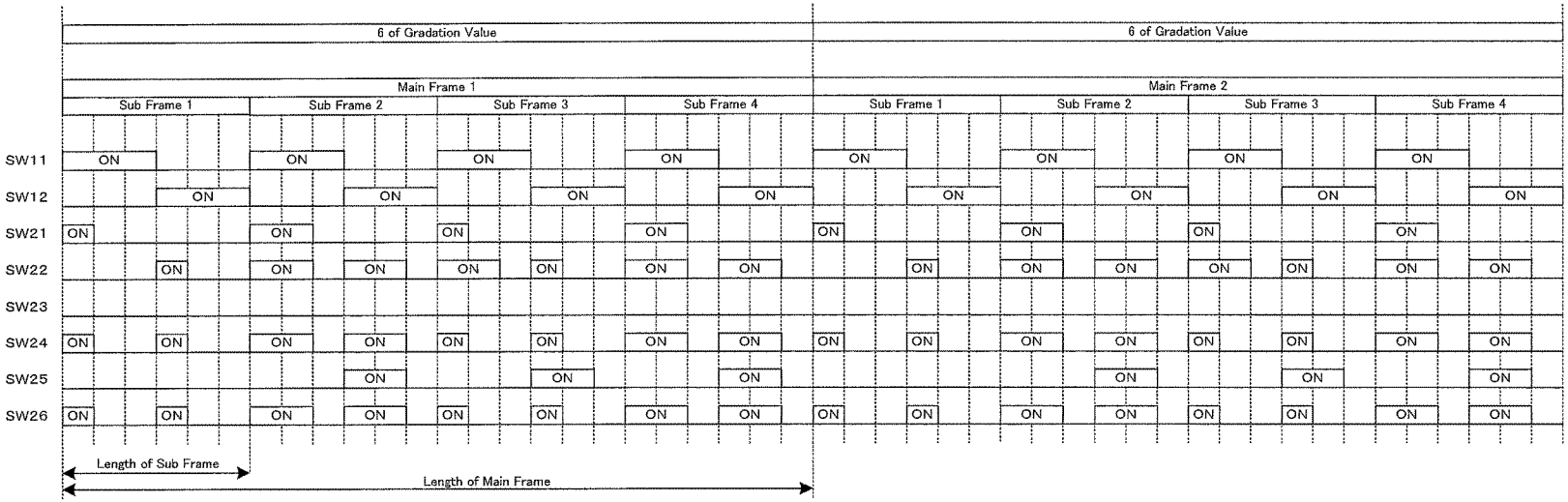
FIG. 3 is a timing chart illustrating an example operation of a control unit 20 of FIG. 1.

FIG. 3 is a timing chart explaining an example of the operation of the control unit 20. As shown in FIG. 3, the control unit 20 controls individual light emitting elements L11-L34 in each of the plurality of main frames. Each main frame includes a plurality of sub-frames, and the control unit 20 applies voltage having a predetermined pulse width to the light emitting elements L11-L34 in each of the individual sub-frames. The length of a main frame is preferably 16.7 ms (60 Hz) or 20 ms (50 Hz) if an image or the like is displayed using multiple main frames, and preferably from 8 ms to 15 ms, if a text message is displayed.

The pulse widths of the voltages in individual sub-frames correspond to the gradation values for the individual sub-frames. The higher the gradation value, the longer the pulse width becomes, and the lower the gradation value, the shorter the pulse width becomes. The quantitative relationship between pulse width and gradation value can be defined in various ways. In the present embodiment, "zero" gradation value corresponds to "zero" pulse width, i.e., when the gradation value is zero, the pulse width is zero. Even in the case of not turning on the light emitting elements, it might be occasionally described herein that "the light emitting elements are turned on at 0 gradation value," or "electric current is supplied to the light emitting elements by applying voltage having 0 pulse width."

The gradation values for individual sub-frames are determined according to the gradation data externally input based on output from an external device. The gradation data includes at least one of the following: gradation values for individual main frames, gradation values for individual sub-frames, and the data from which these gradation values can be derived. The gradation value for one main frame equals the sum of the gradation values for the sub-frames constituting the main frame. The control unit 20, the external device which outputs gradation data, or the like, distributes the gradation value of individual main frames to the plurality of sub-frames constituting the main frame. The display device 1 may include a memory 30 that stores the gradation value for each sub-frame. In this case, the control unit 20 controls lighting of the light emitting elements L11-L34 based on the gradation values stored in the memory 30.

FIG. 4 is a chart that explains in detail how the green light emitting elements L21-L24 are controlled. In FIG. 4, the leftmost column shows the gradation values for a main frame, and four other columns on the right show the gradation values for the sub-frames that constitute the main frame. In the example shown in FIG. 3, one main frame is structured with four sub-frames.

In the case where the gradation value of the main frame is 0 or 1, or 7 or higher, the control unit 20 controls lighting of the green light emitting elements L21-L24 such that the difference between the gradation value of a sub-frame having the maximum gradation value and the gradation value of a sub-frame having the minimum gradation value is 1 at most. For example, when the gradation value of the main frame is 7, the sub-frames 2, 3, and 4 respectively have the maximum gradation values, and the sub-frame 1 has the minimum gradation value. The gradation value of the sub-frame 2, 3, or 4 is 2, respectively, and the gradation value of the sub-frame 1 is 1, and thus the difference between the gradation value of a sub-frame having the maximum gradation value and the gradation value of a sub-frame having the minimum gradation value is 1.

In contrast, for the main frames each having the gradation value of 2 or higher but 6 at most, the control unit 20 controls lighting of the green light emitting elements L21-L24 such that the difference between the gradation value of a sub-frame having the maximum gradation value and the gradation value of a sub-frame having the minimum gradation value is at least 2. For example, for the main frame having the gradation value of 6, the sub-frames 2, 3, and 4 have the maximum gradation value, and the sub-frame 1 has the minimum gradation value. The gradation value of the sub-frame 2, 3, or 4 is 2, and the gradation value of the sub-frame 1 is 0, and thus the difference between the gradation value of sub-frames having the maximum gradation value and the gradation value of a sub-frame having the minimum gradation value is 2.

FIG. 5 is a chart that explains in detail how the red light emitting elements L11-L14 are controlled. Similar to FIG. 4, the leftmost column shows the gradation values for a main frame, and the four other columns on the right show the gradation values for the sub-frames that constitute the main frame. In the example shown in FIG. 5, one main frame is also structured with four sub-frames as shown in FIG. 4.

The control unit 20 controls lighting of the red light emitting elements L11-L14 such that the difference between the gradation value of a sub-frame having the maximum gradation value and the gradation value of a sub-frame having the minimum gradation value is 1 at most, regardless of the gradation value of the main frame. For example, if the gradation value of the main frame is 6, the sub-frames 2 and 4 have the maximum gradation value, and the sub-frames 1 and 3 have the minimum gradation value. Since the gradation value of the sub-frame 2 or 4 is 2, and the gradation value of the sub-frame 1 or 3 is 1, the difference between the gradation value of a sub-frame having the maximum gradation value and the gradation value of a sub-frame having the minimum gradation value is 1.

The blue light emitting elements L31-L34 are controlled in the same way as the red light emitting elements L11-L14, and thus the drawing and the explanation for them will be omitted.

As described above, the control unit 20 controls lighting of the green light emitting elements L21-L24 so that the difference between the gradation value of a sub-frame having the maximum gradation value and the gradation value of a sub-frame having the minimum gradation value is at least 2, if the gradation value of the main frame is at least 2 but 6 at most. In this manner, even if the gradation value of a main frame is too low to distribute adequately large graduation values to all sub-frames, in other words, where the desired chromaticity cannot be obtained in any sub-frame, the green light emitting elements L21-L24 can be turned on in a sub-frame having the maximum gradation value using a relatively high gradation value. In addition, even though a chromaticity shift is likely to occur in a sub-frame having the minimum gradation value due to an increased transient state period as compared to the steady state period, the shift would not be distinguishable because the lighting period for the light emitting elements itself is shorter than that of the other sub-frames, or they are not turned on. Accordingly, the green light emitting elements L21-L24 can be turned on with a chromaticity that is close to the desired chromaticity when the green light emitting elements L21-L24 are viewed in a main frame as a whole. The gradation value of a sub-frame having the maximum gradation value is high, but the gradation value of the main frame as a whole can be maintained because the gradation value of a sub-frame having the minimum gradation value is kept low.

The control unit 20 controls lighting of the red light emitting elements L11-L14 and the blue light emitting elements L31-L34 such that the difference between the gradation value of a sub-frame having the maximum gradation value and the gradation value of a sub-frame having the minimum gradation value is 1 at most, regardless of the gradation value of the main frame. This reduces the time where the light emitting elements are continuously not turned on, thereby reducing the occurrences of a flickering phenomenon, i.e., wavering of a displayed image. The red light emitting elements L11-L14 and the blue light emitting elements L31-L34 have a larger steady state period in the total lighting period even when having a short lighting period as compared to the green light emitting elements L21-L24. For this reason, they can relatively be easy to obtain a chromaticity close to the desired chromaticity even if the lighting is controlled as described above.

According to the present embodiment discussed above, a display device can be provided in which the difference between a desired chromaticity and the chromaticity actually obtained is less likely to be distinguishable even when the luminance is relatively low.

The pulse width in a sub-frame having the maximum gradation value is preferably longer than 100 ns, more preferably longer than 200 ns. This can increase the steady state period even for the green light emitting elements L21-L24, thereby allowing them to turn on with a chromaticity that is close to the desired chromaticity.

The steady state period with respect to a total lighting period in a sub-frame having the maximum gradation value is preferably at least 50%. This allows the green light emitting elements L21-L24 to turn on with a chromaticity that is even closer to the desired chromaticity in a sub-frame having the maximum gradation value. The steady state period with respect to a total lighting period in a sub-frame having the minimum gradation value is preferably 50% at most. This makes the lighting period for the light emitting elements itself shorter in a sub-frame having the minimum gradation value than that in the other sub-frames, or they are not turned on, thereby allowing the green light emitting elements L21-L24 to turn on with a chromaticity that is even closer to the desired chromaticity in a sub-frame having the minimum gradation value when viewed in a main frame as a whole.

In the present embodiment, as predetermined light emitting elements, the green light emitting elements L21-L24, are controlled differently from the red light emitting elements L11-L14 and the blue light emitting elements L31-L34. However, all light emitting elements may be, as predetermined light emitting elements, controlled to turn on such that the difference between the gradation value of a sub-frame having the maximum gradation value and the gradation value of a sub-frame having the minimum gradation value is at least 2. This can unify the lighting control method thereby simplifying the method for controlling the light emitting elements.

In the present embodiment, the green light emitting elements L21-L24 are controlled such that the difference between the gradation value of a sub-frame having the maximum gradation value and the gradation value of a sub-frame having the minimum gradation value is at least 2 for a predetermined main frame having a gradation value of 2 or higher but 6 or lower. However, the main frame in which this control method is applied can be suitably determined. Alternatively, this control method can be applied to all main frames. The present embodiment is particularly effective in the case where the gradation value of at least one of the sub-frames cannot turn on the subject light emitting elements with a desired chromaticity, assuming that the gradation value of one main frame is equally distributed among multiple sub-frames that constitute the main frame. If equal distribution is impossible, the gradation value can be distributed to the sub-frames in such a way that the difference between the gradation value of a sub-frame having the maximum gradation value and the gradation value of a sub-frame having the minimum gradation value is 1 at most, in order to obtain the above-mentioned effect.

Another Example of the Operation of the Control Unit 20

Figure 6:
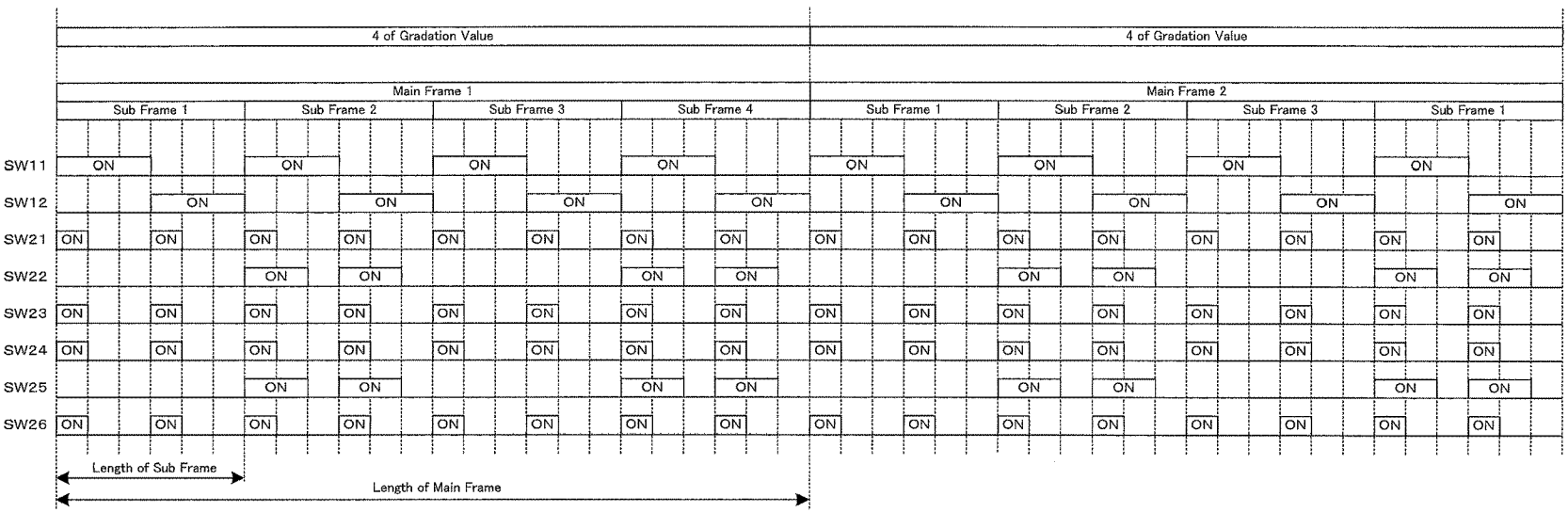
FIG. 6 is a timing chart illustrating another example operation of the control unit 20 of FIG. 1.

FIG. 6 is a timing chart explaining another example of the operation of the control unit 20. As shown in FIG. 6, the control unit 20, in the case where a predetermined main frame includes a plurality of sub-frames having the maximum gradation value and a plurality of sub-frames having the minimum gradation value, preferably turns on predetermined light emitting elements such that the sub-frames having the maximum gradation values and the sub-frames having the minimum gradation values alternate. In other words, the control unit preferably applies control, if the gradation value of the main frame is 4, for example, such that the gradation value of the sub-frames 1 and 3 is 0 and the gradation value of the sub-frames 2 and 4 is 2. This can reduce the time during which the light emitting elements are continuously not turned on, thereby attenuating the flickering phenomenon (i.e., wavering of a displayed image), as compared to the case where they do not alternate, for example, when each of the gradation value of the sub-frames 1 and 2 is 2 and each of the gradation value of the sub-frame 3 and 4 is 0.

EXAMPLE

The display device in an example will be explained next.

The display device in the Example includes 1728 light emitting elements arranged at 4 mm intervals both vertically and horizontally, 24 common lines arranged in a horizontal direction, 216 drive lines (72×3 colors) arranged in a vertical direction, a 5V DC constant voltage source as a power supply, an FPGA as a control unit, P-channel FETs as source drivers, and constant current driven NPN transistors as sink drivers.

The display device has 576 pixels, each pixel including a red light emitting element, a green light emitting element, and a blue light emitting element. In other words, the 1728 light emitting elements consist of 576 red light emitting elements, 576 green light emitting elements, and 576 blue light emitting elements. The sink drivers are set to supply a 16.8 mA current to the red light emitting elements, 18.7 mA current to the green light emitting elements, and 16.8 mA current to the blue light emitting elements. The common lines are respectively connected to the anode sides of the light emitting elements, and the drive lines are respectively connected to the cathode sides of the light emitting elements.

Voltage is applied to each common line using a time-division dynamic lighting system. The duty ratio is 1/24, and the duration of voltage application per common line is 47.9 μs, and the duration when no voltage is applied to any common line is 10 μs. Here (47.9 μs+10 μs)×24 duty=1.389 ms. Thus, the length of a sub-frame is 1.389 ms.

A main frame is configured with 32 sub-frames. 1.389 ms×32=44.4 ms, and thus the length of a main frame is 44.4 ms.

The gradation value for each sub-frame is set to be controlled by pulse width modulation to 64 levels (0-63). The gradation value for the entire main frame can be controlled to 2048 levels (0-2047; 32 sub-frames×64 levels). Pulse width and gradation value are assumed to be in the relationship: Pulse Width=Gradation Value×72.9 ns.

It is assumed that the green light emitting elements can achieve a chromaticity close to the desired chromaticity (i.e., the chromaticity achieved when the pulse width is adequately large; hereinafter the same applies in the Example) by applying voltage having a pulse width of at least 1166.7 ns, in other words, voltage of a gradation value of at least 16 (i.e., 1166.7 ns/72.9 ns≈16). On the other hand, it is assumed that the red and blue light emitting elements can achieve a chromaticity close to the desired chromaticity by applying voltage having a pulse width of at least 72.9 ns, in other words, voltage of a gradation value of at least 1 (i.e., 72.9 ns/72.9 ns=1).

The cases where the gradation values for the green light emitting elements in a main frame in the display device described above are 1024 and 32 will be examined.

When the gradation value of a main frame is 1024, the main frame is set such that the total gradation value 1024 is equally distributed among the sub-frames, and the green light emitting elements are turned on in each sub-frame using a gradation value of 32 (the gradation value of the entire main frame 1024/the number of sub-frames 32=32). Accordingly, the pulse width in each sub-frame is 2333.3 ns (i.e., 72.9 ns×gradation value 32=2333.3 ns), and the green light emitting elements turn on with desired chromaticity.

In the case where the gradation value 32 of an entire main frame is equally distributed among the sub-frames, the gradation value for each sub-frame would be 1 (i.e., the gradation value of the entire main frame 32/the number of sub-frames 32=1). The pulse width for each sub-frame would thus be 72.9 ns (72.9 ns×gradation value 1=72.9 ns), making the chromaticity of the green light emitting elements unstable to achieve the desired chromaticity in all sub-frames. Accordingly, in the case where the gradation value for the entire main frame is 32, the control unit is set to turn on the green light emitting elements such that the sub-frames having a gradation value of 0 (i.e., gradation value not resulting in a desired chromaticity) and the sub-frames having a gradation value of 2 (gradation value achieving a chromaticity close to the desired chromaticity) alternate.

The control unit is set to control to turn on the red and blue light emitting elements using a gradation value of 1 in all sub-frames whether the gradation value for the green light emitting elements in a main frame is 1024 or 32.

Figure 7:
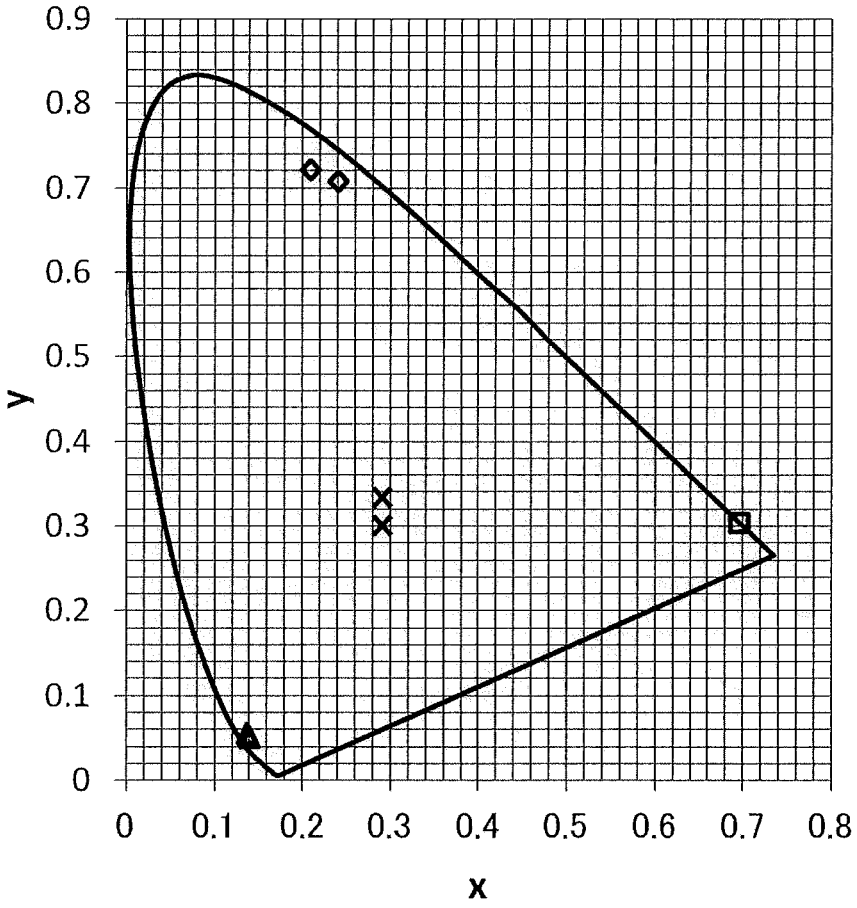
FIG. 7 is a chromaticity diagram based on TABLE 1.

TABLE 1 shows the chromaticity obtained by the lighting control method described above, and FIG. 7 shows the chromaticity diagram based on TABLE 1.

TABLE 1

| Gradation | White | | Red | | Green | | Blue | |
|---|---|---|---|---|---|---|---|---|
| Value | x | y | x | y | x | y | x | y |
| 32 | 0.290 | 0.334 | 0.696 | 0.303 | 0.241 | 0.708 | 0.137 | 0.055 |
| 1024 | 0.290 | 0.301 | 0.696 | 0.303 | 0.209 | 0.720 | 0.139 | 0.050 |

Here, in TABLE 1, the "Red" columns show the chromaticity obtained by the red light emitting elements, the "Green" columns show the chromaticity obtained by the green light emitting elements, the "Blue" columns show the chromaticity obtained by the blue light emitting elements, and the "White" columns show the chromaticity obtained by all of the red light emitting elements, green light emitting elements, and blue light emitting elements. In other words, the "White" columns show the composite chromaticity that combines the chromaticity obtained by the red, green, and blue light emitting elements.

As shown in TABLE 1, in the display device in this Example, when the gradation value for the entire main frame is 32, the values x and y of the green light emitting elements are respectively 0.241 and 0.708. Also, when the gradation value of the entire main frame is 1024, the values x and y of the green light emitting elements are respectively 0.209 and 0.720. Accordingly, for the green light emitting elements, there is a shift of 0.032 (=0.241−0.209) in x value and a shift of 0.012 (=0.720−0.708) in y value between the total main frame gradation values of 32 and 1024. When the gradation value is 32, the luminance of the light emitting elements is 7.2 cd/m$^2$ for "White", 1.3 cd/m$^2$ for "Red", 5.2 cd/m$^2$ for "Green", and 0.5 cd/m$^2$ for "Blue". When the gradation value is 1024, the luminance of the light emitting elements is 206.5 cd/m$^2$ for "White", 48.8 cd/m$^2$ for "Red", 141.0 cd/m$^2$ for "Green", and 16.4 cd/m$^2$ for "Blue".

A display device in a Comparative Example will be explained next.

Figure 8:
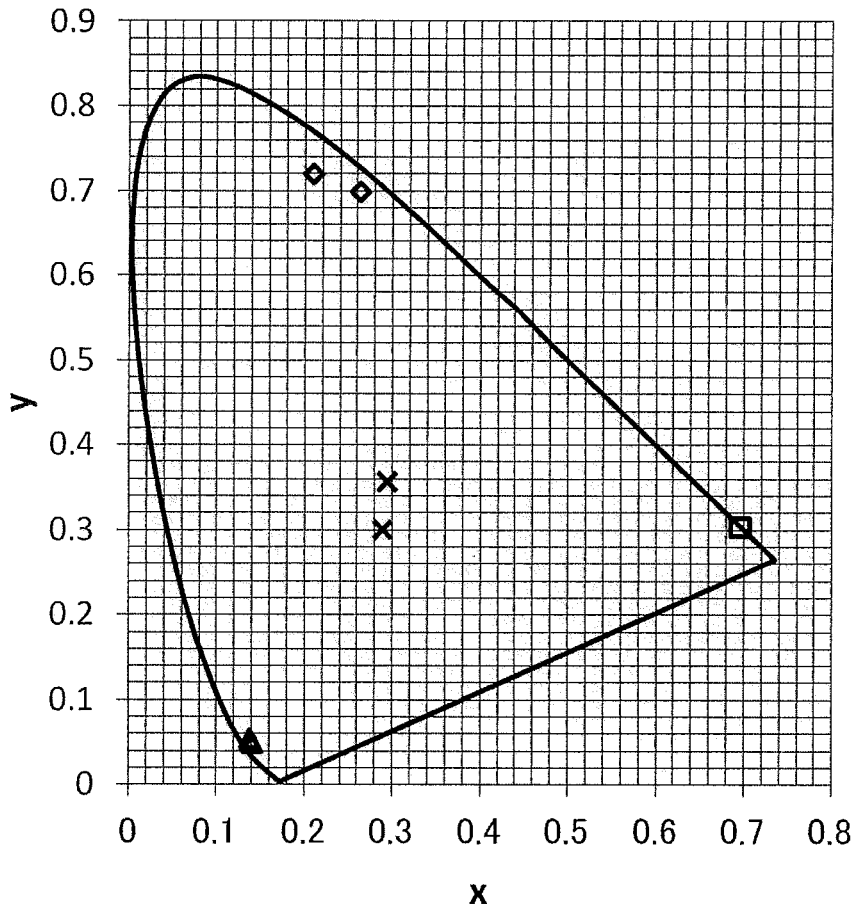
FIG. 8 is a chromaticity diagram based on TABLE 2.

The display device in the Comparative Example differs from the display device in the Example in terms of the lighting control method for the green light emitting elements. It is otherwise the same as or similar to the display device in the Example. To specifically explain, in the Comparative Example, even when the gradation value for the entire main frame is 32, the gradation value for the entire main frame is equally distributed to the sub-frames, and the green light emitting elements are turned on with a gradation value of 1 (i.e., the gradation value resulting in unstable chromaticity) in all sub-frames. TABLE 2 shows the chromaticity obtained by such lighting control, and FIG. 8 shows the chromaticity diagram based on TABLE 2.

TABLE 2

| Gradation | White | | Red | | Green | | Blue | |
|---|---|---|---|---|---|---|---|---|
| Value | x | y | x | y | x | y | x | y |
| 32 | 0.294 | 0.357 | 0.696 | 0.303 | 0.263 | 0.699 | 0.137 | 0.055 |
| 1024 | 0.289 | 0.300 | 0.696 | 0.303 | 0.208 | 0.721 | 0.139 | 0.050 |

As shown in TABLE 2, in the display device in the Comparative Example, when the gradation value for the entire main frame is 32, the values x and y of the green light emitting elements are respectively 0.263 and 0.699. Also, when the gradation value is 1024, the values x and y of the green light emitting elements are respectively 0.208 and 0.721. Accordingly, for the green light emitting elements, there is a shift of 0.055 (=0.263−0.208) in x value, and a shift of 0.022 (=0.721−0.699) in y value between the total main frame gradation values of 32 and 1024. When the gradation value is 32, the luminance of the light emitting elements is 8.0 cd/m$^2$ for "White", 1.3 cd/m$^2$ for "Red", 5.9 cd/m$^2$ for "Green", and 0.5 cd/m$^2$ for "Blue". When the gradation value is 1024, the luminance of the light emitting elements is 204.9 cd/m$^2$ for "White", 48.5 cd/m$^2$ for "Red", 140.9 cd/m$^2$ for "Green", and 16.4 cd/m$^2$ for "Blue".

As discussed above, in the display device in the Comparative Example, there is an x value shift of 0.055 and a y value shift of 0.022 for the green light emitting elements between the total main frame gradation values of 32 and 1024. In contrast, according to the display device in the Example, the x value shift can be reduced to 0.032, and the y value shift can be reduced to 0.012. Accordingly, the display device of the Example can bring the chromaticity of the green light emitting elements closer to the desired chromaticity under the condition that the total gradation value of a main frame is low, compared to the display device in the Comparative Example.

The certain embodiment and example explained above merely illustrate examples, and do not in any way limit the present invention as defined by the scope of the claims.

The display device according to the present invention can be utilized, for example, in a large screen television as well as a message board displaying information such as traffic updates.

What is claimed is:

1. A display device comprising:

a display unit including a plurality of light emitting elements: and a control unit that individually controls the plurality of light emitting elements in each of a plurality of main frames according to gradation data externally input based on output from an external device, wherein the plurality of main frames each include a plurality of sub-frames of equal duration, the control unit is configured to apply, by pulse width modulation, voltage to predetermined ones of the plurality of light emitting elements in a predetermined one of the plurality of main frames such that a difference, with respect to the predetermined main frame, between a maximum gradation value and a minimum gradation value is at least 2, the gradation value being defined per sub-frame and corresponding to a pulse width of the voltage, and the longer the pulse width, the higher the gradation value becomes.

2. The display device according to claim 1 further comprising:

a memory for storing the gradation values to be distributed to the plurality of sub-frames that constitute one of the plurality of main frames, wherein the control unit individually turns on the plurality of light emitting elements based on the gradation values stored in the memory.

3. The display device according to claim 2, wherein the control unit, in the predetermined main frames, turns on the predetermined ones of the plurality of light emitting elements such that a steady state period with respect to a total lighting period in one or more sub-frames having the maximum gradation value is at least 50%, while turning on the predetermined ones of the plurality of light emitting elements such that the steady state period with respect to the total lighting period in one or more sub-frames having the minimum gradation value is 50% at most, the steady period being a state in which the output of a light emitting element is stable, the total lighting period being a period from the rise to the fall of the output of the light emitting element.

4. The display device according to claim 2, wherein the predetermined main frame constitutes one or more sub-frames having the maximum gradation value, and one or more sub-frame having the minimum gradation value, and the control unit, in the predetermined main frame, turns on the predetermined ones of the plurality of light emitting elements such that the one or more sub-frames having the maximum gradation value and the one or more sub-frames having the minimum gradation values alternate.

5. The display device according to claim 2, wherein the pulse width in one or more sub-frames having the maximum gradation value is longer than 100 ns.

6. The display device according to claim 2, wherein the plurality of light emitting elements include one or more green light emitting elements.

7. The display device according to claim 2, wherein the display unit includes a plurality of pixels, the plurality of pixels each include at least one red light emitting element, at least one green light emitting element, and at least one blue light emitting element, and the predetermined ones of the plurality of light emitting elements include one or more green light emitting elements.

8. The display device according to claim 1, wherein the control unit, in the predetermined main frames, turns on the predetermined ones of the plurality of light emitting elements such that a steady state period with respect to a total lighting period in one or more sub-frames having the maximum gradation value is at least 50%, while turning on the predetermined ones of the plurality of light emitting elements such that the steady state period with respect to the total lighting period in one or more sub-frames having the minimum gradation value is 50% at most, the steady period being a state in which the output of a light emitting element is stable, the total lighting period being a period from the rise to the fall of the output of the light emitting element.

9. The display device according to claim 8, wherein the predetermined main frame constitutes one or more sub-frames having the maximum gradation value, and one or more sub-frame having the minimum gradation value, and the control unit, in the predetermined main frame, turns on the predetermined ones of the plurality of light emitting elements such that the one or more sub-frames having the maximum gradation value and the one or more sub-frames having the minimum gradation values alternate.

10. The display device according to claim 8, wherein the pulse width in one or more sub-frames having the maximum gradation value is longer than 100 ns.

11. The display device according to claim 8, wherein the plurality of light emitting elements include one or more green light emitting elements.

12. The display device according to claim 8, wherein the display unit includes a plurality of pixels, the plurality of pixels each include at least one red light emitting element, at least one green light emitting element, and at least one blue light emitting element, and the predetermined ones of the plurality of light emitting elements include one or more green light emitting elements.

13. The display device according to claim 1, wherein the predetermined main frames constitutes one or more sub-frames having the maximum gradation value, and one or more sub-frame having the minimum gradation value, and the control unit, in the predetermined main frame, turns on the predetermined ones of the plurality of light emitting elements such that the one or more sub-frames having the maximum gradation value and the one or more sub-frames having the minimum gradation values alternate.

14. The display device according to claim 13, wherein the display unit includes a plurality of pixels, the plurality of pixels each include at least one red light emitting element, at least one green light emitting element, and at least one blue light emitting element, and the predetermined ones of the plurality of light emitting elements include one or more green light emitting elements.

15. The display device according to claim 1, wherein the pulse width in one or more sub-frames having the maximum gradation value is longer than 100 ns.

16. The display device according to claim 1, wherein the plurality of light emitting elements include one or more green light emitting elements.

17. The display device according to claim 1, wherein the display unit includes a plurality of pixels, the plurality of pixels each include at least one red light emitting element, at least one green light emitting element, and at least one blue light emitting element, and the predetermined ones of the plurality of light emitting elements include one or more green light emitting elements.

* * * * *